US011109151B2

(12) United States Patent
Mate et al.

(10) Patent No.: US 11,109,151 B2
(45) Date of Patent: Aug. 31, 2021

(54) RECORDING AND RENDERING SOUND SPACES

(71) Applicant: Nokia Technologies Oy, Espoo (FI)

(72) Inventors: Sujeet Shyamsundar Mate, Tampere (FI); Lasse Laaksonen, Tampere (FI)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 16/624,988

(22) PCT Filed: Jun. 21, 2018

(86) PCT No.: PCT/FI2018/050487
§ 371 (c)(1),
(2) Date: Dec. 20, 2019

(87) PCT Pub. No.: WO2019/002676
PCT Pub. Date: Jan. 3, 2019

(65) Prior Publication Data

US 2020/0177993 A1 Jun. 4, 2020

(30) Foreign Application Priority Data

Jun. 27, 2017 (GB) ..... 1710236.9

(51) Int. Cl.
*H04R 3/00* (2006.01)
*H04R 1/08* (2006.01)
(Continued)

(52) U.S. Cl.
CPC ..... *H04R 3/005* (2013.01); *H04R 1/08* (2013.01); *H04R 1/406* (2013.01); *H04R 29/005* (2013.01)

(58) Field of Classification Search
CPC ..... H04R 3/005; H04R 1/08; H04R 1/406; H04R 29/005
(Continued)

(56) References Cited

U.S. PATENT DOCUMENTS 5,497,090 A * 3/1996 Macovski ..... G01R 33/3628 324/314
7,876,914 B2 * 1/2011 Grosvenor ..... H04H 60/47 381/92
(Continued)

FOREIGN PATENT DOCUMENTS

GB 2540175 A 1/2017
JP 2016144112 * 8/2016
JP 2016144112 A 8/2016

OTHER PUBLICATIONS

Alexandridis, A., et al. "Breaking Down the Cocktail Party: Capturing and Isolating Sources in a Soundscape", in: Proc. European Signal Processing Conference (USIPCO) [online], Lisbon, Portugal, Sep. 1-5, 2014, [retrieved on Nov. 12, 2018], retrieved from https://ieeexplore.ieee.org/document/6952383; 5 pgs.

*Primary Examiner* — Vivian C Chin
*Assistant Examiner* — Con P Tran
(74) *Attorney, Agent, or Firm* — Harrington & Smith

(57) ABSTRACT

A method, apparatus and computer program, the method including enabling an output of an audio mixer to be rendered for a user where the user is located within a sound space, wherein at least one input channel is provided to the audio mixer and the at least one input channel receives a plurality of microphone output signals obtained by a plurality of microphones recording the sound space; determining that a first microphone records one or more sound objects within the sound space; and in response to the determining, enabling one or more of the plurality of microphone output signals to be, at least partially, removed from the at least one input channel to the audio mixer.

20 Claims, 8 Drawing Sheets

(51) Int. Cl.
*H04R 1/40* (2006.01)
*H04R 29/00* (2006.01)

(58) Field of Classification Search
USPC ..... 381/92, 310, 119, 122, 77; 700/74
See application file for complete search history.

(56) References Cited

U.S. PATENT DOCUMENTS

| | | | | |
|---|---|---|---|---|
| 2009/0190769 | A1 | 7/2009 | Wang et al. | 381/66 |
| 2011/0002469 | A1* | 1/2011 | Ojala | H04S 7/30 381/22 |
| 2015/0380010 | A1 | 12/2015 | Srinivasan | |

* cited by examiner

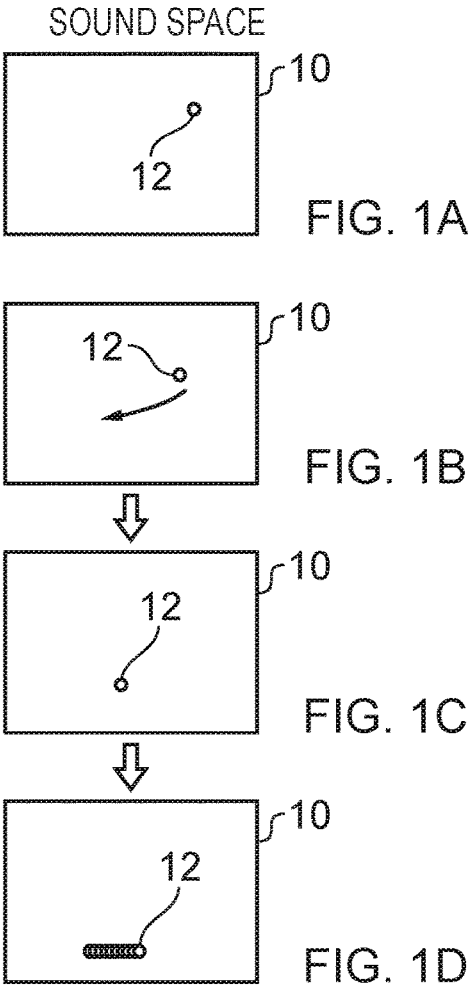
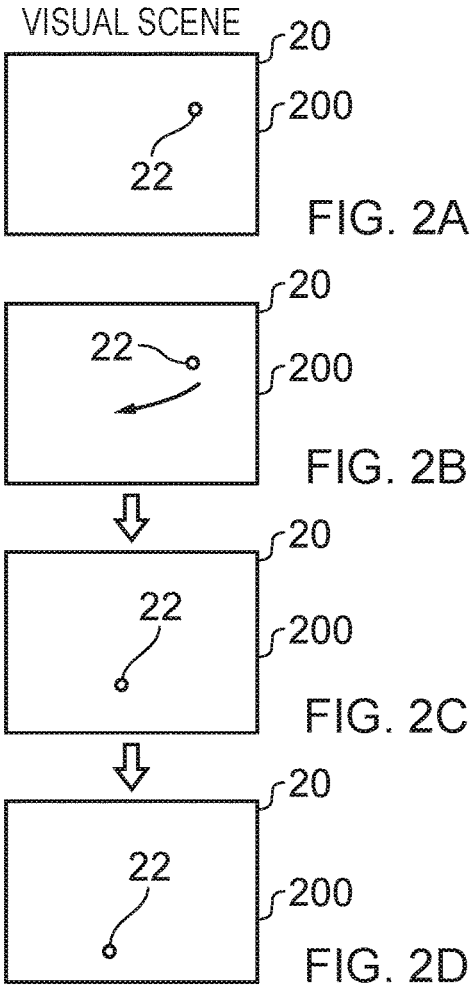
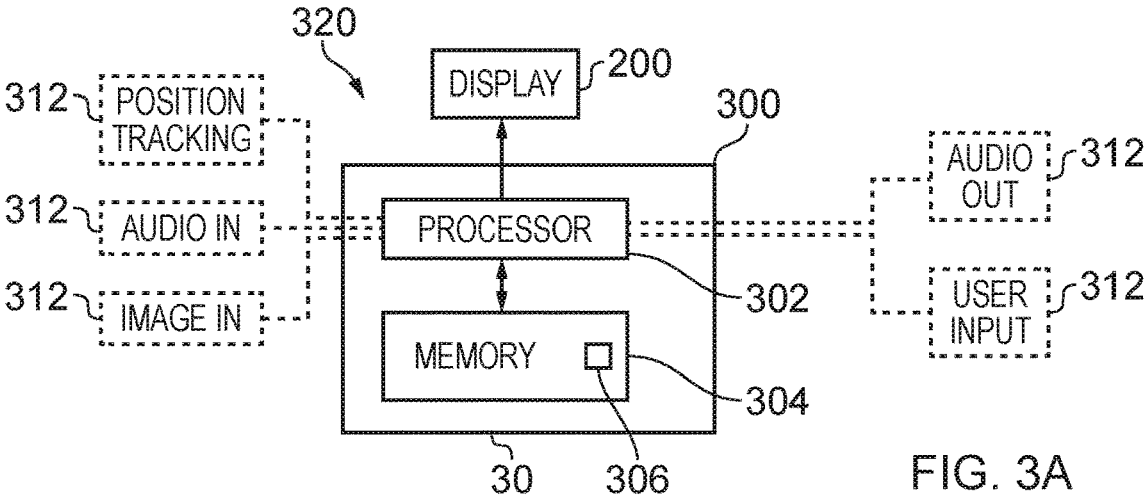
FIG. 3A
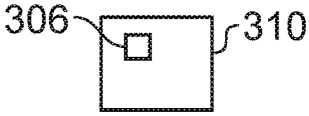
FIG. 3B

RECORDING AND RENDERING SOUND SPACES

CROSS REFERENCE TO RELATED APPLICATION

This patent application is a U.S. National Stage application of International Patent Application Number PCT/FI2018/050487 filed Jun. 21, 2018, which is hereby incorporated by reference in its entirety, and claims priority to GB 1710236.9 filed Jun. 27, 2017.

TECHNOLOGICAL FIELD

Embodiments of the invention relate to recording and rendering sound spaces. In particular they relate to recording and rendering sound spaces where a user may be located within the sound space and may be free to move within the sound space.

BACKGROUND

Sound spaces may be recorded and rendered in any applications where spatial audio is used. For example the sound spaces may be recorded for use in mediated reality content applications such as virtual reality or augmented reality applications.

To enable sound spaces to be accurately reproduced it is useful to use a plurality of microphones. However increasing the number of microphones used increases the amount of data that has to be provided to an audio mixer. If the user's rendering device is located separately to the audio mixer then the signal comprising the audio output may be transmitted via a wireless communication link. The amount of data that can be transmitted may be limited by the bandwidth of the communication link. This may limit the quality of the audio output that can be recorded and subsequently rendered for the user via the audio mixer.

BRIEF SUMMARY

According to various, but not necessarily all, examples of the disclosure there is provided a method comprising: enabling an output of an audio mixer to be rendered for a user where the user is located within a sound space, wherein at least one input channel is provided to the audio mixer and the at least one input channel receives a plurality of microphone output signals obtained by a plurality of microphones recording the sound space; determining that a first microphone records one or more sound objects within the sound space; and in response to the determining, enabling one or more of the plurality of microphone output signals to be, at least partially, removed from the at least one input channel to the audio mixer.

The method may comprise replacing the removed one or more microphone output signals in the output provided to the user with a signal recorded by the first microphone.

The first microphone may be a microphone associated with the user. The microphone associated with the user may be worn by the user. The microphone associated with the user may be located in a head set worn by the user.

Determining that a first microphone can be used to record one or more sound objects within the sound space may comprise determining that a signal captured by the first microphone has at least one parameter within a threshold range.

Determining that a first microphone can be used to record one or more sound objects within the sound space may comprise determining that the user is located within a threshold distance of the one or more sound objects.

The method may comprise identifying one or more microphone output signals that correspond to the sound object that can be recorded by the microphone associated with the user.

The plurality of microphones may enable a sound object within the sound space to be isolated.

Enabling one or more of the microphone output signals to be, at least partially, removed from the input channel to the audio mixer may occur automatically when it is determined that the microphone associated with the user can be used to record the sound object.

Enabling one or more of the microphone output signals to be, at least partially, removed from the input channel to the audio mixer may comprise sending a signal to an audio mixing device indicating that one or more of the microphone output signals can be, at least partially, removed. The signal sent to the audio mixing device may comprise information that enables a controller to identify the microphone output signals that can be, at least partially, removed. The signal sent to the audio mixing device may identify the microphone output signals that can be, at least partially, removed.

The signal recorded by the first microphone might not be provided to the audio mixer.

The signals provided by the first microphone may provide a higher quality output than the microphone output signals that are, at least partially, removed from the input channel to the audio mixer.

At least partially removing one or more of the plurality of output signals from the input channel to the audio mixer may increase the efficacy of the available bandwidth between the audio mixer and a user device.

According to various, but not necessarily all, examples of the disclosure there is provided an apparatus comprising: processing circuitry; and memory circuitry including computer program code, the memory circuitry and the computer program code configured to, with the processing circuitry, enable the apparatus to: enable an output of an audio mixer to be rendered for a user where the user is located within a sound space, wherein at least one input channel is provided to the audio mixer and the at least one input channel receives a plurality of microphone output signals obtained by a plurality of microphones recording the sound space; determine that a first microphone records one or more sound objects within the sound space; and in response to the determining, enable one or more of the plurality of microphone output signals to be, at least partially, removed from the at least one input channel to the audio mixer.

The memory circuitry and the computer program code may be configured to, with the processing circuitry, enable the apparatus to replace the, at least partially, removed one or more microphone output signals in the output provided to the user with a signal recorded by the first microphone.

The first microphone may be a microphone associated with the user. The microphone associated with the user may be worn by the user. The microphone associated with the user may be located in a head set worn by the user.

Determining that a first microphone can be used to record one or more sound objects within the sound space may comprise determining that a signal captured by the first microphone has at least one parameter within a threshold range.

Determining that a first microphone can be used to record one or more sound objects within the sound space may comprise determining that the user is located within a threshold distance of the one or more sound objects.

The memory circuitry and the computer program code may be configured to, with the processing circuitry, enable the apparatus to identify one or more microphone output signals that correspond to the sound object that can be recorded by the microphone associated with the user.

The plurality of microphones may enable a sound object within the sound space to be isolated.

Enabling one or more of the microphone output signals to be, at least partially, removed from the input channel to the audio mixer may occur automatically when it is determined that the microphone associated with the user can be used to record the sound object.

Enabling one or more microphone output channels to be, at least partially, removed from the input channel to the audio mixer may comprise sending a signal to an audio mixing device indicating that one or more of the microphone output signals can be, at least partially, removed.

The signal sent to the audio mixing device may comprise information that enables a controller to identify the microphone output signals that can be, at least partially, removed.

The signal sent to the audio mixing device may identify the microphone output signals that can be, at least partially, removed.

The signal recorded by the first microphone might not be provided to the audio mixer.

The signals provided by the first microphone may provide a higher quality output than the microphone output signals that are removed from the input channel to the audio mixer.

At least partially removing one or more of the plurality of output signals from the input channel to the audio mixer may increase the efficacy of the available bandwidth between the audio mixer and a user device.

According to various, but not necessarily all, examples of the disclosure there is provided an apparatus comprising: means for enabling an output of an audio mixer to be rendered for a user where the user is located within a sound space, wherein at least one input channel is provided to the audio mixer and the at least one input channel receives a plurality of microphone output signals obtained by a plurality of microphones recording the sound space; means for determining that a first microphone records one or more sound objects within the sound space; and means for enabling, in response to the determining, one or more of the plurality of microphone output signals to be, at least partially, removed from the at least one input channel to the audio mixer.

According to various, but not necessarily all, examples of the disclosure there is provided an electronic device comprising an apparatus as described above.

The electronic device may be arranged to be worn by a user.

According to various, but not necessarily all, examples of the disclosure there is provided a computer program comprising computer program instructions that, when executed by processing circuitry, enable: enabling an output of an audio mixer to be rendered for a user where the user is located within a sound space, wherein at least one input channel is provided to the audio mixer and the at least one input channel receives a plurality of microphone output signals obtained by a plurality of microphones recording the sound space; determining that a first microphone records one or more sound objects within the sound space; and in response to the determining, enabling one or more of the plurality of microphone output signals to be, at least partially, removed from the at least one input channel to the audio mixer.

According to various, but not necessarily all, examples of the disclosure there is provided a computer program comprising program instructions for causing a computer to perform any of the methods described above.

According to various, but not necessarily all, examples of the disclosure there is provided a physical entity embodying the computer programs as described above.

According to various, but not necessarily all, examples of the disclosure there is provided an electromagnetic carrier signal carrying the computer programs as described above.

BRIEF DESCRIPTION

For a better understanding of various examples that are useful for understanding the detailed description, reference will now be made by way of example only to the accompanying drawings in which:

FIGS. 1A to 1D illustrate examples of a sound space comprising one or more sound objects;

FIGS. 2A to 2D illustrate examples of a recorded visual scene that respectively correspond with the sound space illustrated in FIGS. 1A to 1D;

FIG. 3A illustrates an example of a controller and FIG. 3B illustrates an example of a computer program;

Figure 7A:
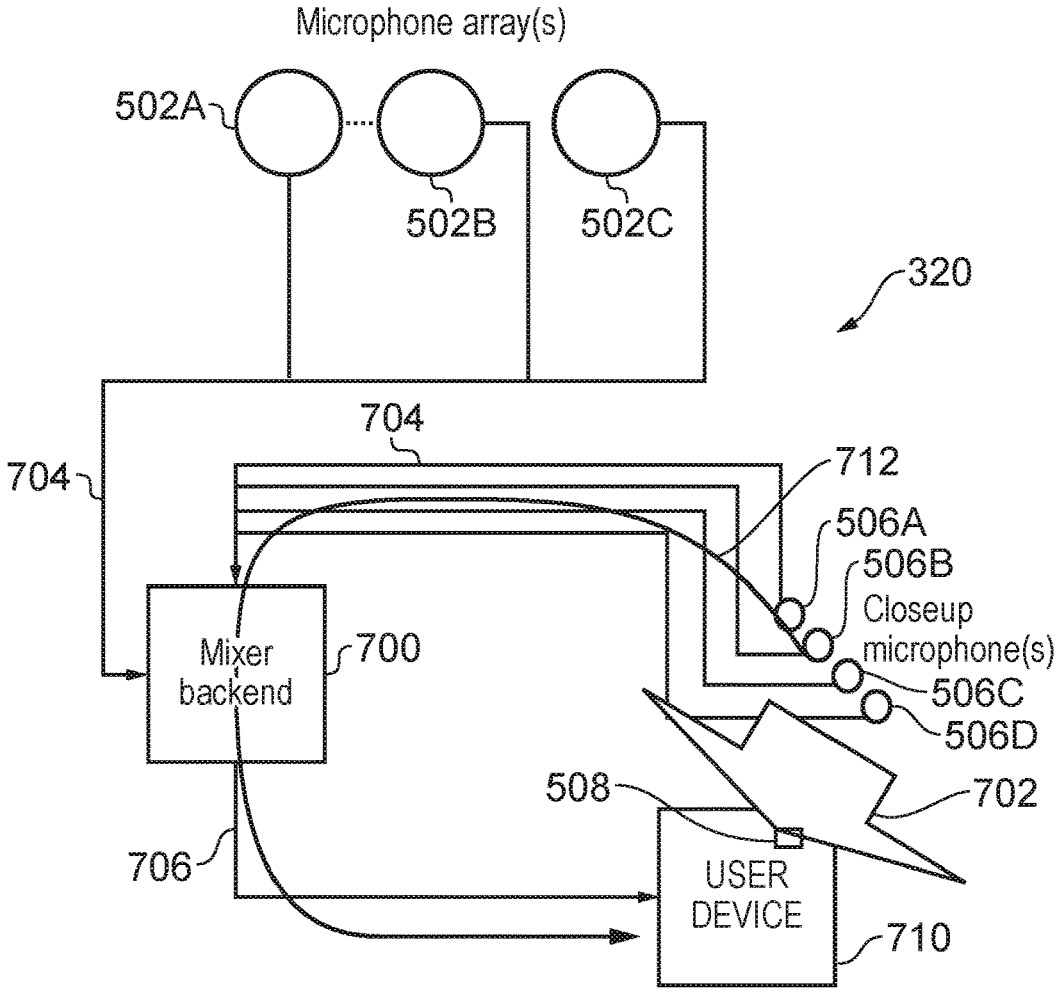
Figure 7B:
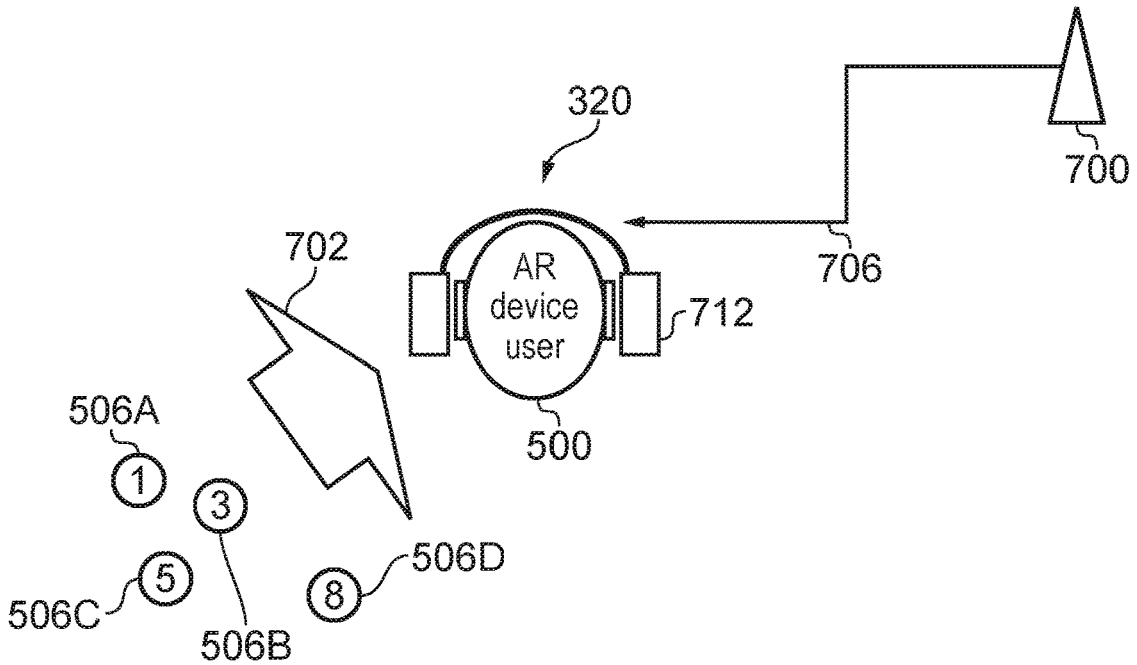
Figure 8:
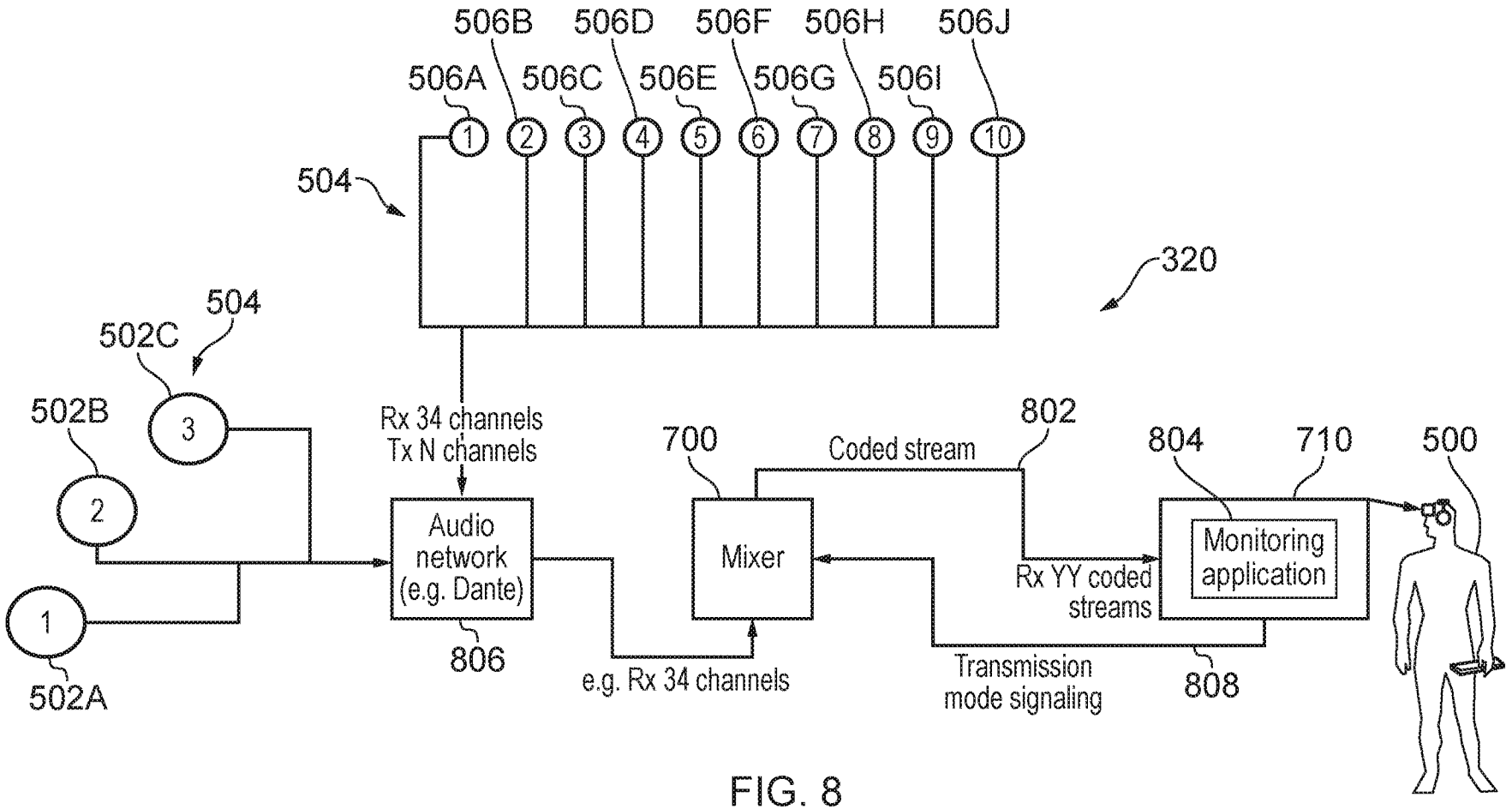
Figure 9:
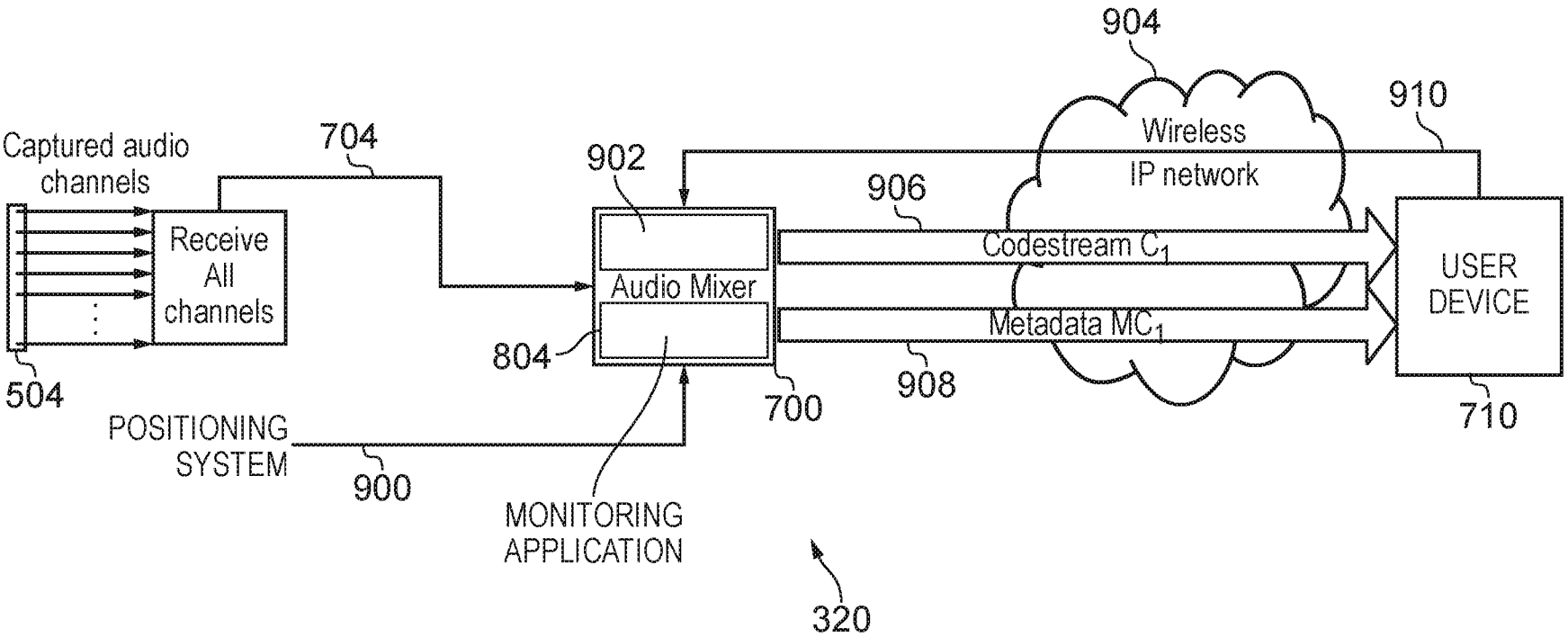
Figure 10:
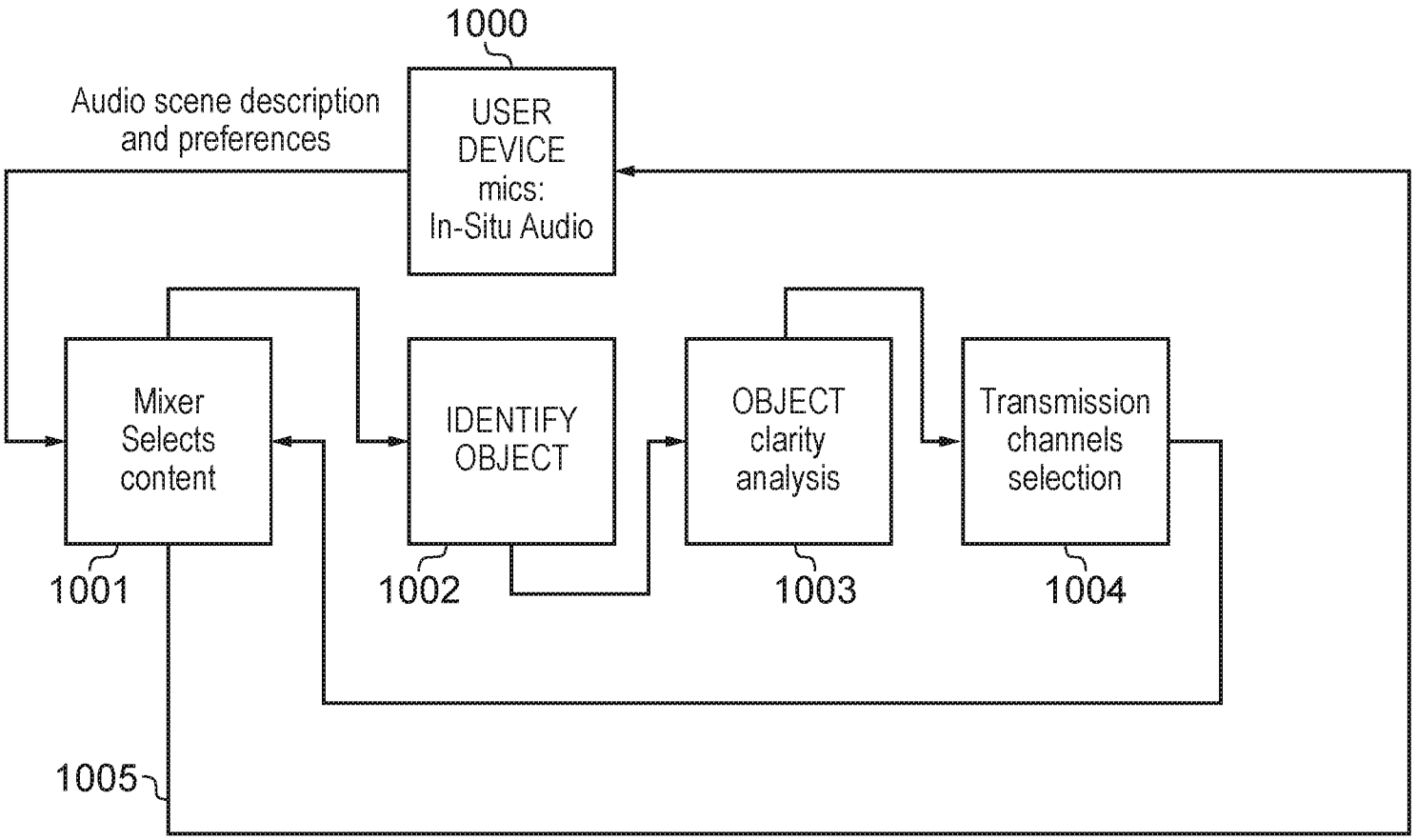

FIGS. 7A and 7B schematically illustrate the routing of signals in examples of the disclosure;

FIG. 8 schematically illustrates a system that may be used to implement examples of the disclosure;

FIG. 9 schematically illustrates a system that may be used to implement examples of the disclosure; and FIG. 10 schematically illustrates another method according to examples of the disclosure.

DEFINITIONS

"Artificial environment" may be something that has been recorded or generated. "Visual space" refers to fully or partially artificial environment that may be viewed that may be three dimensional.

"Visual scene" refers to a representation of the visual space viewed from a particular point of view within the visual space.

"Visual object" is a visible object within a virtual visual scene.

"Sound space" refers to an arrangement of sound sources in a three-dimensional space. A sound space may be defined in relation to recording sounds (a recorded sound space) and in relation to rendering sounds (a rendered sound space).

"Sound scene" refers to a representation of the sound space listened to from a particular point of view within the sound space.

"Sound object" refers to a sound source that may be located within the sound space. A source sound object represents a sound source within the sound space. A recorded sound object represents sounds recorded at a particular microphone or position. A rendered sound object represents sounds rendered from a particular position.

"Virtual space" may mean a visual space, a sound space or a combination of a visual space and corresponding sound space. In some examples, the virtual space may extend horizontally up to 360° and may extend vertically up to 180°.

"Virtual scene" may mean a visual scene, a sound scene or a combination of a visual scene and a corresponding sound scene.

"Virtual object" is an object within a virtual scene, it may be an artificial virtual object (such as a computer generated virtual object) or it may be an image of a real object that is live or recorded. It may be a sound object and/or a visual object.

"Correspondence" or "corresponding" when used in relation to a sound space and a virtual visual space means that the sound space and virtual visual space are time and space aligned, that is they are the same space at the same time.

"Correspondence" or "corresponding" when used in relation to a sound scene and a visual scene means that the sound scene and visual scene are corresponding and a notional listener whose point of view defines the sound scene and a notional viewer whose point of view defines the visual scene are at the same position and orientation, that is they have the same point of view.

"Real space" refers to a real environment, which may be three dimensional.

"Real visual scene" refers to a representation of the real space viewed from a particular point of view within the real space.

"Real visual object" is a visible object within a real visual scene.

The "visual space", "visual scene" and "visual object" may also be referred to as the "virtual visual space", "virtual visual scene" and "virtual visual object" to clearly differentiate them from "real visual space", "real visual scene" and "real visual object".

"Mediated reality" in this document refers to a user visually experiencing a fully or partially artificial environment (a virtual space) as a virtual scene at least partially rendered by an apparatus to a user. The virtual scene is determined by a point of view within the virtual space. Displaying the virtual scene means providing it in a form that can be perceived by the user.

"Mediated reality content" is content which enables a user to visually experience a fully or partially artificial environment (a virtual space) as a virtual visual scene. Mediated reality content could include interactive content such as a video game or non-interactive content such as motion video or an audio recording.

"Augmented reality" in this document refers to a form of mediated reality in which a user experiences a partially artificial environment (a virtual space) as a virtual scene comprising a real scene of a physical real world environment (real space) supplemented by one or more visual or audio elements rendered by an apparatus to a user.

"Augmented reality content" is a form of mediated reality content which enables a user to visually experience a partially artificial environment (a virtual space) as a virtual visual scene.

Augmented reality content could include interactive content such as a video game or non-interactive content such as motion video or an audio recording.

"Virtual reality" in this document refers to a form of mediated reality in which a user experiences a fully artificial environment (a virtual visual space) as a virtual scene displayed by an apparatus to a user.

"Virtual reality content" is a form of mediated reality content which enables a user to visually experience a fully artificial environment (a virtual space) as a virtual visual scene. Virtual reality content could include interactive content such as a video game or non-interactive content such as motion video or an audio recording.

"Perspective-mediated" as applied to mediated reality, augmented reality or virtual reality means that user actions determine the point of view within the virtual space, changing the virtual scene.

"First person perspective-mediated" as applied to mediated reality, augmented reality or virtual reality means perspective mediated with the additional constraint that the user's real point of view determines the point of view within the virtual space;

"Third person perspective-mediated" as applied to mediated reality, augmented reality or virtual reality means perspective mediated with the additional constraint that the user's real point of view does not determine the point of view within the virtual space;

"User interactive" as applied to mediated reality, augmented reality or virtual reality means that user actions at least partially determine what happens within the virtual space;

"Displaying" means providing in a form that is perceived visually (viewed) by the user.

"Rendering" means providing in a form that is perceived by the user

DETAILED DESCRIPTION

The following description describes methods, apparatus and computer programs that control how audio content is recorded and rendered to a user. In particular they control how the audio content is recorded and rendered as a user moves within a sound space.

FIG. 1A illustrates an example of a sound space 10 comprising a sound object 12 within the sound space 10. The sound object 12 may be a sound object as recorded or it may be a sound object as rendered. It is possible, for example using spatial audio processing, to modify a sound object 12, for example to change its sound or positional characteristics. For example, a sound object can be modified to have a greater volume, to change its position within the sound space 10 (FIGS. 1B & 1C) and/or to change its spatial extent within the sound space 10 (FIG. 1D)

FIG. 1B illustrates the sound space 10 before movement of the sound object 12 in the sound space 10. FIG. 1C illustrates the same sound space 10 after movement of the sound object 12.

The sound object 12 may be a sound object as recorded and be positioned at the same position as a sound source of the sound object or it may be positioned independently of the sound source.

The position of a sound source may be tracked to render the sound object at the position of the sound source. This may be achieved, for example, when recording by placing a positioning tag on the sound source. The position and any changes in the position of the sound source can then be recorded. The positions of the sound source may then be used to control a position of the sound object 12. This may be particularly suitable where a close-up microphone is used to record the sound source. In the example of FIG. 1C the sound source has moved. It is to be appreciated that the user could move within the sound space 10 as well as, or instead of, the sound object 12.

In other examples, the position of the sound source within the visual scene may be determined during recording of the sound source by using spatially diverse sound recording. An example of spatially diverse sound recording is using a microphone array. The phase differences between the sound recorded at the different, spatially diverse microphones, provides information that may be used to position the sound source using a beam forming equation. For example, time-difference-of-arrival (TDOA) based methods for sound source localization may be used.

The positions of the sound source may also be determined by post-production annotation. As another example, positions of sound sources may be determined using Bluetooth-based indoor positioning techniques, or visual analysis techniques, a radar, or any suitable automatic position tracking mechanism.

FIG. 1D illustrates a sound space 10 after extension of the sound object 12 in the sound space 10. The sound space 10 of FIG. 1D differs from the sound space 10 of FIG. 10 in that the spatial extent of the sound object 12 has been increased so that the sound object has a greater breadth (greater width).

In some examples, a visual scene 20 may be rendered to a user that corresponds with the rendered sound space 10. The visual scene 20 may be the scene recorded at the same time the sound source that creates the sound object 12 is recorded.

FIG. 2A illustrates an example of a visual scene 20 that corresponds with the sound space 10. Correspondence in this sense means that there is a one-to-one mapping between the sound space 10 and the visual scene 20 such that a position in the sound space 10 has a corresponding position in the visual scene 20 and a position in the visual scene 20 has a corresponding position in the sound space 10. Corresponding also means that the coordinate system of the sound space 10 and the coordinate system of the visual scene 20 are aligned such that an object is positioned as a sound object 12 in the sound space 10 and as a visual object 22 in the visual scene 20 at the same common position from the perspective of a user.

The sound space 10 and the visual scene 20 may be three-dimensional.

A portion of the visual scene 20 is associated with a position of visual object 22 representing a sound source within the visual scene 20. The position of the visual object 22 representing the sound source in the visual scene 20 corresponds with a position of the sound object 12 within the sound space 10.

In this example, but not necessarily all examples, the sound source is an active sound source producing sound that is or can be heard by a user depending on the position of the user within the sound space 10, for example via rendering or live, while the user is viewing the visual scene via the display 200.

In some examples, parts of the visual scene 20 are viewed through the display 200 (which would then need to be a see-through display). In other examples, the visual scene 20 is rendered by the display 200.

In an augmented reality application, the display 200 is a see-through display and at least parts of the visual scene 20 is a real, live scene viewed through the see-through display 200. The sound source may be a live sound source or it may be a sound source that is rendered to the user. This augmented reality implementation may, for example, be used for capturing an image or images of the visual scene 20 as a photograph or a video.

In another application, the visual scene 20 may be rendered to a user via the display 200, for example, at a location remote from where the visual scene 20 was recorded. This situation is similar to the situation commonly experienced when reviewing images via a television screen, a computer screen or a mediated/virtual/augmented reality headset. In these examples, the visual scene 20 is a rendered visual scene. The active sound source produces rendered sound, unless it has been muted. This implementation may be particularly useful for editing a sound space by, for example, modifying characteristics of sound sources and/or moving sound sources within the visual scene 20.

FIG. 2B illustrates a visual scene 20 corresponding to the sound space 10 of FIG. 1B, before movement of the sound source in the visual scene 20. FIG. 2C illustrates the same visual scene 20 corresponding to the sound space 10 of FIG. 10, after movement of the sound source.

FIG. 2D illustrates the visual scene 20 after extension of the sound object 12 in the corresponding sound space 10. While the sound space 10 of FIG. 1D differs from the sound space 10 of FIG. 10 in that the spatial extent of the sound object 12 has been increased so that the sound object has a greater breadth, the visual scene 20 is not necessarily changed.

The above described methods may be performed using an apparatus 30 such as a controller 300. An example of a controller 300 is illustrated in FIG. 3A.

Implementation of the controller 300 may be as controller circuitry. The controller 300 may be implemented in hardware alone, have certain aspects in software including firmware alone or can be a combination of hardware and software (including firmware).

As illustrated in FIG. 3A the controller 300 may be implemented using instructions that enable hardware functionality, for example, by using executable instructions of a computer program 306 in a general-purpose or special-purpose processor 302 that may be stored on a computer readable storage medium (disk, memory etc.) to be executed by such a processor 302.

The processor 302 is configured to read from and write to the memory 304. The processor 302 may also comprise an output interface via which data and/or commands are output by the processor 302 and an input interface via which data and/or commands are input to the processor 302.

The memory 304 stores a computer program 306 comprising computer program instructions (computer program code) that controls the operation of the apparatus 30 when loaded into the processor 302. The computer program instructions, of the computer program 306, provide the logic and routines that enables the apparatus to perform the methods illustrated in the figures. The processor 302 by reading the memory 304 is able to load and execute the computer program 306.

The controller 300 may be part of an apparatus 30 or system 320. The apparatus 30 or system 320 may comprise one or more peripheral components 312. The display 200 is a peripheral component. Other examples of peripheral components 312 may include: an audio output device or interface for rendering or enabling rendering of the sound space 10 to the user; a user input device for enabling a user to control one or more parameters of the method; a positioning system for positioning a sound object 12 and/or the user; an audio input device such as a microphone or microphone array for recording a sound object 12; an image input device such as a camera or plurality of cameras.

The apparatus 30 or system 320 may be comprised in a headset for providing mediated reality.

The controller 300 may be configured as a sound rendering engine that is configured to control characteristics of a sound object 12 defined by sound content. For example, the rendering engine may be configured to control the volume of the sound content, a position of the sound object 12 for the sound content within the sound space 10, a spatial extent of new sound object 12 for the sound content within the sound space 10, and other characteristics of the sound content such as, for example, tone or pitch or spectrum or reverberation etc. The sound object 12 may, for example, be rendered via an audio output device or interface. The sound content may be received by the controller 300.

The sound rendering engine may, for example comprise a spatial audio processing system that is configured to control the position and/or extent of a sound object 12 within a sound space 10. The sound rendering engine may enable any properties of the sound object 12 to be controlled. For instance, the sound rendering engine may enable reverberation, gain or any other properties to be controlled.

Figure 4:
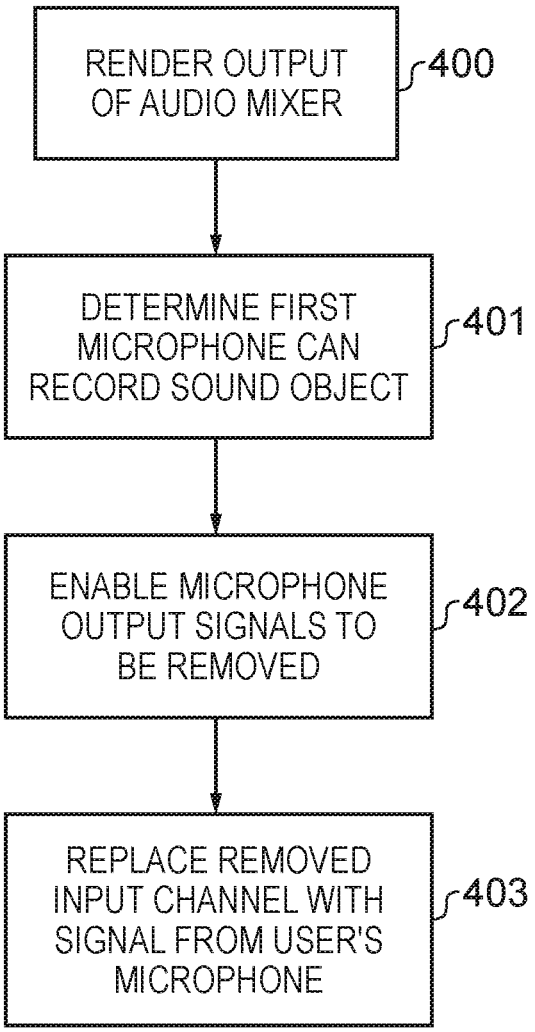
FIG. 4 illustrates a method.

FIG. 4 illustrates a method according to examples of the disclosure. The method may be implemented using an apparatus 30, controller 300 or system 312 as described above.

The method comprises, at block 400, enabling an output of an audio mixer 700 to be rendered for a user 500 where the user 500 is located within a sound space 10. The sound space 10 may comprise one or more sound objects 12.

The audio mixer 700 may be arranged to receive a plurality of input channels and combine these to provide an output to the user 500. In other examples the audio mixer 700 may be arranged to receive a single input channel. The single input channel could comprise a plurality of combined signals.

The one or more input channels comprises a plurality of microphone output signals obtained by a plurality of microphones 504 which are arranged to record the sound space 10. In some examples one input channel could comprise a plurality of microphone output signals. In other examples a plurality of input channels could comprise a plurality of microphone output signals.

In some of these examples each of the plurality of input channels could comprise a single microphone output signal or alternatively, some of the plurality of input channels could comprise two or more microphone output signals.

The plurality of microphones 504 may comprise any arrangement of microphones which enables spatially diverse sound recording. The plurality of microphones 504 may comprise one or more microphone arrays 502, and one or more close up microphones 506 or any other suitable types of microphones and microphone arrangements.

The plurality of microphones 504 may be arranged to enable a sound object 12 within the sound space 10 to be isolated. The sound object 12 may be isolated in that it can be separated from other sound objects within the sound space 10. This may enable the microphone output signals associated with the sound object 12 to be identified and removed from the input channels provided to the mixer. The plurality of microphones 504 may comprise any suitable means which enable the sound object 12 to be isolated. In some examples the plurality of microphones 504 may comprise one or more directional microphones or microphone arrays which may be focused on the sound object 12. In some examples the plurality of microphones 504 may comprise one or more microphones positioned close to the sound object 12 so that they mainly record the sound object. In some examples processing means may be used to analyse the input channels and/or the microphone output signals and identify the microphone output signals corresponding to the sound object 12.

The output of the audio mixer 700 may be rendered using any suitable rendering device. In some examples the output may be rendered using an audio output device 312 positioned within a head set. The head set could be used for mediated reality applications or any other suitable applications.

The rendering device may be located separately to the audio mixer 700. For example the rendering device may be worn by the user 500 while the device which comprises the audio mixer 700 may be in a device which is separate from the user. The output of the audio mixer 700 may be provided to the rendering device via a wireless communication link so that the user can move within the sound space 10. The quality of the signal that can be transmitted via the wireless communication link may be limited by the bandwidth of the communication link. This may limit the quality of the audio output that can be rendered for the user via the audio mixer 700 and the headset.

At block 401 it is determined that a first microphone 508 can be used to record one or more sound objects 12 within the sound space 10. The first microphone 508 may be a microphone 508 associated with the user 500. In other examples the first microphone 508 could be one of the plurality microphones 504.

The microphone 508 that is associated with the user 500 may be worn by, or positioned close to the user 500. The microphone 508 that is associated with the user 500 may move with the user 500 so that as the user 500 moves through the sound space 10 the microphone 508 also moves. In some examples the microphone 508 may be positioned within the rendering device. For example, a mediated reality headset may also comprise one or more microphones.

Determining that a first microphone 508 can be used to record one or more sound objects 12 within the sound space 10 may comprise determining that the microphone 508 can obtain high quality audio signals. This may enable a high quality output, representing the sound object 12, to be provided to the user 500. The high quality output may enable the sound object 12 to be recreated more faithfully than the output of the audio mixer 700. It may be determined that the audio signal has a high quality by determining that at least one parameter of the signal is within a threshold range. The parameters could be any suitable parameter such as, but not limited to, frequency range or clarity.

In some examples determining that a first microphone 508 can be used to record one or more sound objects 12 within the sound space 10 may comprise determining that the user 500 is located within a threshold distance of the one or more sound objects 12. For example if the user 500 is located close enough to a sound object 12 it may be determined that the microphone 508 associated with the user 500 should be able to obtain a high quality signal. In some examples the direction of the user 500 relative to the sound object 12 may also be taken into account when determining whether or not a high quality signal could be obtained. The positioning device 312 of the apparatus 30 could be used to determine the relative positions of the user 500 and the sound object 12.

The sound object may be an object that is positioned close to the first microphone 508. In other examples the sound object could be located far away from the first microphone 508.

At block 402 the method comprises enabling one or more of the microphone output signals to be, at least partially, removed from the input channel to the audio mixer 700. This enables the controller 300 to switch into an improved bandwidth mode of operation.

In some examples enabling the microphone output signals to be, at least partially, removed may comprise sending a signal to the audio mixer 700 to cause the microphone output signals to be, at least partially, removed. In some examples the signal sent to the audio mixer 700 identifies the microphone output signals that can be, at least partially, removed. In other examples the signal sent to the audio mixer 700 may comprise information which enables the audio mixer 700 to identify the microphone output signals that can be, at least partially, removed.

Any suitable means may be used to identify the microphone output signals that can be, at least partially, removed from the input to the audio mixer 700. In some examples the microphone output signals may be identified as the microphone output signals that correspond to the sound object 12 that can be recorded by the first microphone 508. The microphone output signals that can be removed may be identified by isolating the sound object 12 and identifying the input channels associated with the isolated sound object 12.

In some examples removing the microphone output signals from the input to the audio mixer 700 may comprise completely removing one or more microphone output signals so that the removed microphone output signals are no longer provided to the audio output mixer. In some examples one or more of the microphone output signals may be partially removed. In such cases part of at least one microphone output signal may be removed so that some of the microphone output signal is provided to the audio mixer 700 and some of the same microphone output signal is not provided to the audio mixer 700.

Removing, at least part of, the one or more microphone output signals changes the output provided by the audio mixer 700 so that the sound object 12 may be removed, or partially removed, from the output. It is to be appreciated that in some examples a subset of microphone output signals would be removed so that at least some microphone output signals are still provided in the input channel to the audio mixer 700. In other examples all of the microphone output signals could be removed. The number of microphone output signals that are, at least partially, removed and the identity of the microphone output signals that are, at least partially, removed would be dependent on the position of the user 500 relative to the sound objects 12 and the clarity with which the microphone 508 associated with the user 500 can record the sound objects. Therefore there may be a plurality of different improved bandwidth modes of operation available where different modes have different microphone output signals removed. The mode that is selected is dependent upon the user's position within the sound space 10.

In examples of the disclosure the enabling the one or more of the microphone output signals to be, at least partially, removed from the input to the audio mixer 700 occurs automatically. The removal of at least part of the microphone output signals may occur without any specific input by the user 500. For example, the removal may occur when it is determined that the microphone 508 associated with the user 500 can be used to record the sound object 12.

In some, but not all examples, the method also comprises, at block 403, replacing the removed one or more microphone output signals in the output provided to the user 500 with a signal recorded by the first microphone 508. The signal recorded by the first microphone 508 is routed differently to the signals recorded by the plurality of microphones 504. The signal recorded by the first microphone 508 is not provided to the audio mixer 700. As the signals representing the sound object 12 are not routed through the audio mixer 700 and do not need to be transmitted to the user via the communication link. This means that they are not limited by the bandwidth of the communication link and so may enable a higher quality signal to be provided to the user 500 when the controller is operating in an improved bandwidth mode of operation. This may increase the efficacy of the available bandwidth between the audio mixer 700 and a user device 710 as it allows for a more efficient use of the bandwidth. In some examples this may optimize the available bandwidth between the audio mixer 700 and a user device 710.

The higher quality of the signal provided to the user 500 may comprise one or more parameters of the audio output that has a higher threshold value in the signal provided by the microphone 508 associated with the user 500 compared to the signal routed via the audio mixer 700. The parameters could be any suitable parameter such as, but not limited to, frequency range or clarity. The higher quality could be achieved using any suitable means. For example the first microphone 508 could have a higher sampling rate. This may enable more information to be obtained and enable the signal recorded by the first microphone 508 to be as faithful a reproduction of the sound object 12 as possible.

In some examples the higher quality may be achieved by reducing the data that needs to be routed via the audio mixer 700. As one or more microphone output signals are removed from the input channel to the audio mixer this reduces the data that needs to be processed and transmitted by the audio mixer 700. This may reduce the processing time and any latency in the output provided to the user. This may also reduce the amount of compression needed to transmit the signal and may enable a higher quality audio output to be provided.

Figure 5:
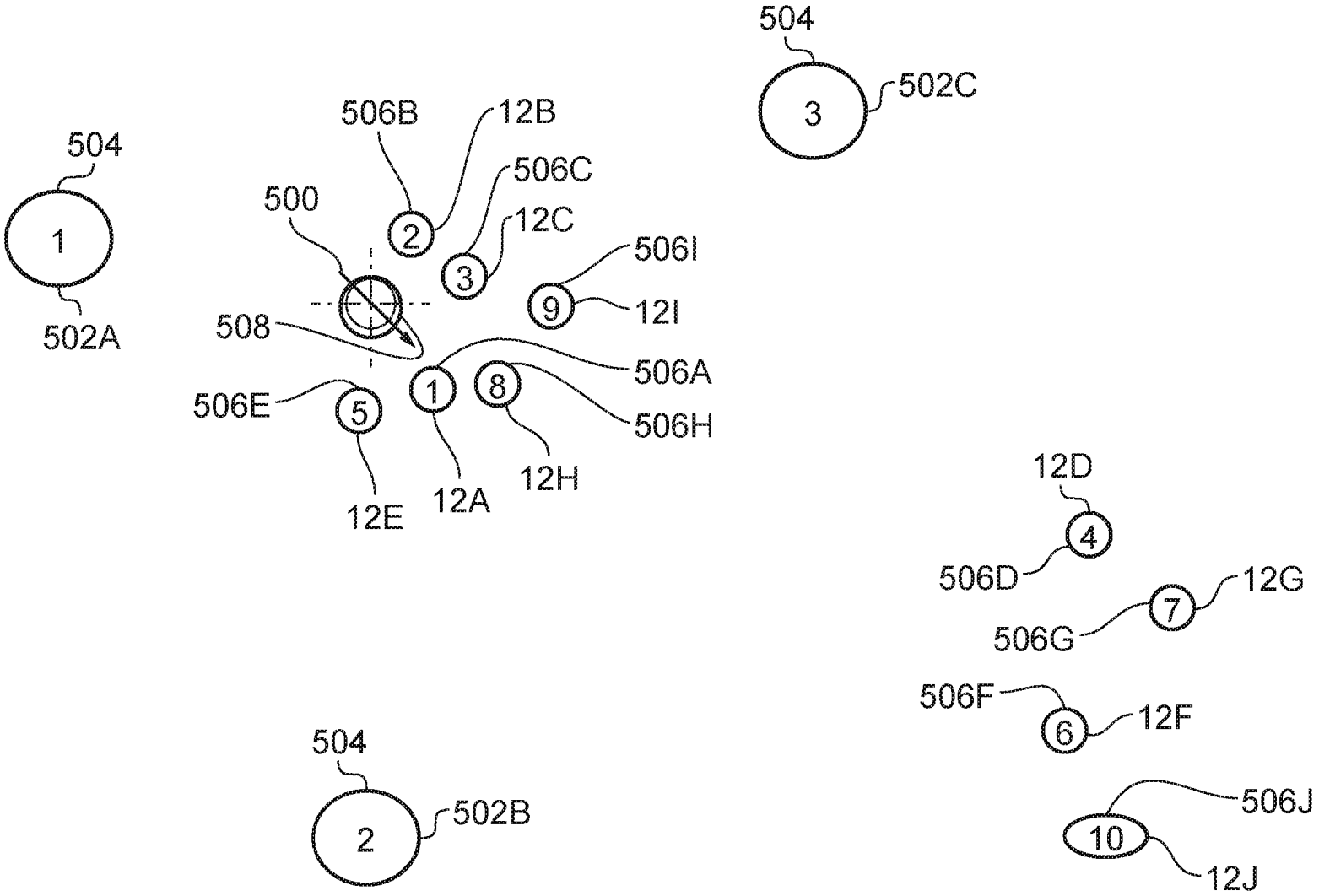
FIG. 5 illustrates an example of a sound space.

FIG. 5 illustrates an example of a sound space comprising a plurality of sound objects 12A to 12J. The sound objects 12A to 12J are distributed throughout the sound space. The example sound space of FIG. 5 could represent the recording of a band or orchestra or other situation comprising a plurality of sound objects 12A to 12J.

The sound space is three-dimensional, so that the location of the user 500 within the sound space has three degrees of freedom, up/down, forward/back, left/right and the direction that the user 500 faces within the sound space has three degrees of freedom, roll, pitch, yaw. The position of the user 500 may be continuously variable in location and direction. This gives the user 500 six degrees of freedom within the sound space.

A plurality of microphones 504 are arranged to enable the sound space to be recorded. The plurality of microphones 504 may comprise any means which enables spatially diverse sound recording. In the example of FIG. 5 the plurality of microphones 504 comprises a plurality of microphone arrays 502A to 502C. The microphone arrays 502A to 502C are positioned around the plurality of sound objects 12A to 12J. The plurality of microphones 504 also comprises a plurality of close up microphones 506. In the example of FIG. 5 the close up microphones 506A to 506J are arranged close to the sound objects 12A to 12J so that the close up microphones 506A to 506J can record the sound objects 12A to 12J.

The user 500 is located within the sound space. The user 500 may be wearing an electronic device such as a headset which enables the user to listen to the sound space. In some examples the user 500 could be located within the sound space while the sound space is being recorded. This may enable the user 500 to check that the sound space is being recorded accurately. In some examples the user 500 could be using augmented reality applications, or other mediated reality applications, in which the user 500 is provided with audio outputs corresponding to the user's 500 position within the sound space.

The output signals of the plurality of microphones 504 may be provided to an audio mixer 700. As a large number of microphones 504 are used to record the sound space this generates a large amount of data that is provided to the audio mixer 700. However the amount of data that can be transmitted from the audio mixer 700 to the user's device may be limited by the bandwidth of the communication link between the user's device and the audio mixer 700. In examples of the disclosure the user's device may be switched to an improved bandwidth mode of operation, as described above, so that some of the signals do not need to be routed via the audio mixer 700.

Figure 6:
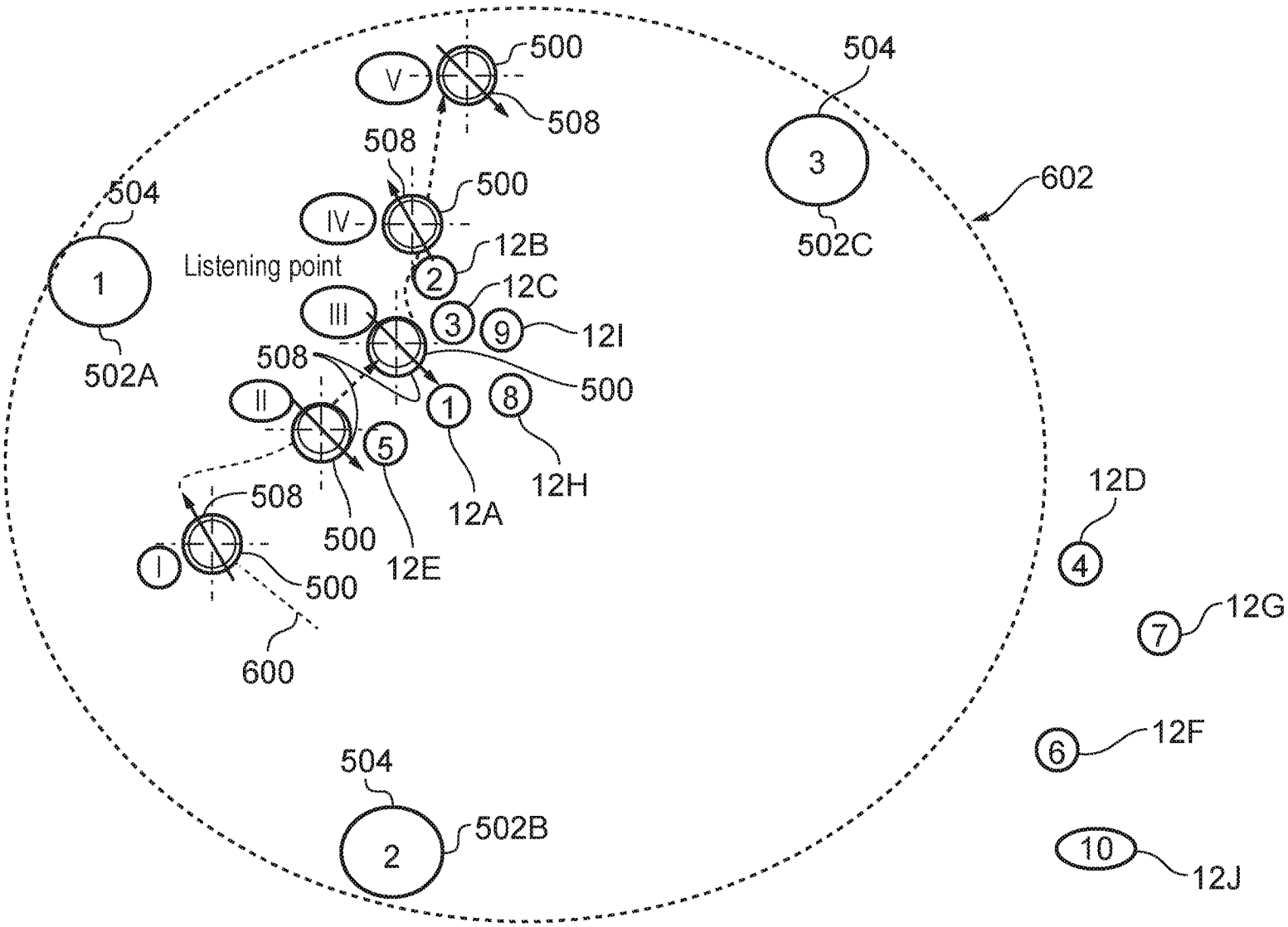
FIG. 6 illustrates an example of a user moving through the sound space.

FIG. 6 illustrates the user 500 moving through the sound space as illustrated in FIG. 5. As the user 500 moves through the sound space the user's device may be switched between improved bandwidth modes of operation and normal modes of operation. In the normal mode of operation all of the signals obtained by the plurality of microphones 504 are routed via the audio mixer 700 while in an improved bandwidth mode of operation only some of the signals obtained by the plurality of microphones 504 are routed via the audio mixer 700.

In FIG. 6 the user 500 follows a trajectory indicted by the dashed line 600. The user 500 moves from location I to location V via locations II, III and IV. The user 500 is wearing a headset or other suitable device which enables the output of an audio mixer 700 to be rendered to the user 500. The output of the audio mixer 700 may provide a recording of the sound space to the user 500.

The user 500 may also be wearing a microphone 508. The microphone 508 may be provided within the headset or in any other suitable device. The user 500 may be wearing the microphone 508 so that as the user 500 moves through the sound space the microphone 508 also moves with them.

When the user 500 is located at location I the audio output that is provided to the user 500 comprises the output of the audio mixer 700. This corresponds to the sound space as captured by the microphone arrays 502A to 502C and the close up microphones 506A to 506C. As a large number of microphones 504 are used to capture the sound scene the data may be compressed before being transmitted to the user 500. This may limit the quality of the audio output.

In the example of FIG. 6 only sound objects 12 within a threshold area may be included in the output. The threshold area is indicated by the dashed line 602. The sound objects 12D, 12G, 12F and 12J are located outside of the threshold area and so are excluded from the audio output. The signals captured by a close up microphones 506D, 506G, 506F, 506J would not be provided to the audio mixer 700.

When the user 500 is located in the first location I the output of the audio mixer 700 is rendered via the user's headset or other suitable device. The output comprises the output of the microphone arrays 502A to 502C mixed with the outputs of the close up microphones 506E, 506A, 506H, 506I, 506C, 506B. At location I the user 500 is located above a threshold distance from the sound objects 12E, 12A, 12H, 12I, 12C and 12B. At this location it may be determined that a microphone 508 associated with the user 500 should not be used to capture these sound objects. This determination may be made based on the relative positions of the user 500 and the sound objects 12E, 12A, 12H, 12I, 12C and 12B and/or an analysis of the signal recorded by the microphone associated with the user 500. In response to this determination the controller 300 remains in the normal mode of operation where all of the signals provided to the user 500 are routed via the audio mixer 700.

The user 500 moves though the sound space from location I to location II. At location II the user 500 is close to the sound object 12E but is still located above a threshold distance from the other sound objects 12A, 12H, 12I, 12C and 12B. It may be determined that the microphone associated with the user 500 can capture the sound object 12E with sufficient quality but not the other sound objects 12A, 12H, 12I, 12C and 12B. In response to this determination the controller 300 switches into an improved bandwidth mode. The microphone output signals corresponding to the sound object 12E are identified and removed from the input channels to the audio mixer 700. These may be replaced in the output with a signal obtained by the microphone 508 associated with the user 500. The signal from the microphone 508 associated with the user 500 is not provided to the audio mixer 700. This signal from the microphone 508 associated with the user 500 is not restricted by the bandwidth of the communication link between the audio mixer 700 and the user's device. This may enable a higher quality signal to be provided to the user 500.

The user 500 then moves though the sound space from location II to location III. At location III the user 500 is close to the sound objects 12E, 12A, 12H, 12I, 12C and 12B. It may be determined that the microphone 508 associated with the user 500 can capture the sound objects 12E, 12A, 12H, 12I, 12C and 12B. In response to this determination the controller 300 switches to a different improved bandwidth mode of operation in which the microphone output signals corresponding to the sound objects 12E, 12A, 12H, 12I, 12C and 12B are identified and removed from the input channels to the audio mixer 700. These may be replaced in the output with a signal obtained by the microphone associated with the user 500. In this location none of the close up microphones are used to provide a signal to the audio mixer 700. The output provided to the user 500 may be a combination of the signal recorded by the microphone 508 associated with the user 500 and the signals recorded by the microphone arrays 502A to 502C.

The user 500 continues along the trajectory to location IV. At location IV the user 500 is still located close to the sound object 12B but is now located above a threshold distance from the other sound objects 12E, 12A, 12H, 12I, and 12C. It may be determined that the microphone associated with the user 500 can still capture the sound object 12B with sufficient quality but not the other sound objects 12E, 12A, 12H, 12I and 12C. In response to this determination the controller 300 switches to another improved bandwidth mode of operation in which the input channels to the audio mixer corresponding to the sound objects 12E, 12A, 12H, 12I, and 12C are identified and reinstated in the inputs to the audio mixer 700.

The user then continues to location V. At location V the user 500 is located above a threshold distance from the sound objects 12E, 12A, 12H, 12I, 12C and 12B. It is determined that the microphone 508 associated with the user can no longer record any of the sound objects 12E, 12A, 12H, 12I, 12C and 12B with sufficient quality and so the controller 300 switches back to the normal mode of operation. In the normal mode of operation all of the microphone output signals are reinstated in the inputs to the audio mixer 700 and the signal captured by the microphone 508 associated with the user 500 is no longer rendered for the user 500.

As the system switches between the different modes of operation temporal latency information from the respective signals may be used to prevent transition artefacts from appearing. The temporal latency information is used to ensure that the signals that are routed through the audio mixer 700 are synchronized with the signals that are not routed through the audio mixer 700.

FIGS. 7A and 7B schematically illustrate the routing of signals captured by the plurality of microphones 504 in different modes of operation according to examples of the disclosure.

FIGS. 7A and 7B illustrates a system 320 comprising an audio mixer 700, a user device 710 and a plurality of microphones 504. The plurality of microphones 504 comprises a plurality of microphone arrays 502A, 502B and 502C and also a plurality of close up microphones 506A to 506D. The plurality of microphones 504 may be arranged within a sound space 10 to enable a plurality of sound objects 12 to be recorded.

The audio mixer 700 comprises any means which may be arranged to receive the inputs channels 704 comprising the microphone output signals from the plurality of microphones 504 and combine these into an output signal for rendering by the user device 710. The output of the audio mixer 700 is provided to the user device 710 via the communication link 706. The communication link 706 may be a wireless communication link.

The user device 710 may be any suitable device which may be arranged to render an audio output for the user 500. The user device 710 may be a head set which may be arranged to render mediated reality applications such as augmented reality or virtual reality. The user device 710 may comprise one or more microphones which may be arranged to record sound objects 12 that are positioned close to the user 500.

When the system 320 is operating in a normal mode of operation all of the signals from the close up microphones 506A to 506D are provided to the audio mixer 700 and included in the output provided to the user device 710 as indicated by arrow 712. The system 320 may operate within the normal mode of operation when the microphone within the user device 710 is determined not to be able to record sound objects within the sound space 10 with high enough quality. For example it may be determined that the distance between the user 500 and the sound object 12 exceeds a threshold.

When the system 320 switches from normal mode to the improved bandwidth mode the sound objects 12 may be recorded by the microphone 508 within the user device 712. This enables the sound object 12 to be provided direct to the user 500, as indicated by arrow 702, without having to be routed via the audio mixer 700.

FIG. 8 schematically illustrates another system 320 that may be used to implement examples of the disclosure. In the example of FIG. 8 the determination of whether to use a normal mode or an improved bandwidth mode is made by the user device 712.

The system 320 of FIG. 8 comprises a plurality of microphones 504, an audio mixer 700 and a user device 710 which may be as described above. The system 320 also comprises an audio network 806 which is arranged to collect the signals from the plurality of microphones 504 and provide them in the input channels to the audio mixer 700. In the example of FIG. 4 the audio mixer 700 has 34 input channels. Other numbers of input channels may be used in other examples of the disclosure.

The output of the audio mixer 700 is transmitted to the user device 710 as a coded stream 802. The coded stream 802 may be transmitted via the wireless communication link.

In the example of FIG. 8 the user device 710 comprises a monitoring module 804. The monitoring module 804 enables a monitoring application to be implemented. The monitoring application 804 may be used to determine whether or not a microphone 508 within the user device 710 can be used to record a sound object 12. The monitoring application 804 may use any suitable methods to make such a determination. For example the monitoring application may monitor the quality of signals recorded by a microphone 508 within the user device 710 and/or may use positioning systems to monitor the position of the user 500 relative to the sound objects 12.

If the monitoring application 804 may cause a signal 808 to be sent to the audio mixer 700 indicating which mode of operation the system 320 should operate in. If it is determined that the microphone 508 can be used to record the sound object 12 then the signal 808 indicates that the system 320 should operate in a reduced bandwidth mode of operation. If it is determined that the microphone 508 cannot be used to record the sound object 12 then the signal 808 indicates that the system 320 should operate in a normal mode of operation. Once the audio mixer 700 has received the signal 808 the audio mixer may remove and/or reinstate microphone output signals as indicated by the signal 808.

FIG. 9 schematically illustrates another system 320 that may be used to implement examples of the disclosure. In the example of FIG. 9 the determination of whether to use a normal mode or an improved bandwidth mode is made by a controller associated with the mixer 700. The system of FIG. 9 comprises a plurality of microphones 504, an audio mixer 700 and a user device 710 which may be as described above.

In the example of FIG. 9 the audio mixer 700 receives the microphone output signals from the plurality of microphones 504. The audio mixer 700 also receives an input 900 comprising information on the sound space and the position of the user 500 within the sound space. The information relating to the sound space may comprise information indicating the locations of the sound objects 12 within the sound space and the user's position relative to the sound objects 12. The input 900 may be obtained from a position system or any other suitable means.

The input signal 900 may be provided to a monitoring module 804 which may comprise a monitoring application. The monitoring application 804 may use the information received in the input signal 900 to determine whether or not a microphone 508 within the user device 710 can be used to record a sound object 12 and cause the system 320 to be switched between the normal modes of operation and the improved bandwidth modes of operation as necessary.

In the example of FIG. 9 the audio mixer 700 comprises a channel selection module 902 which is arranged to remove and reinstate the microphone output signals from the input channel of the audio mixer 700 as indicated by the monitoring module 804. This enables the system 320 to be switched between the different modes of operation. Once the microphone output signals have been removed or reinstated as needed the signal 906 is transmitted to the user device 710 via a wireless network 904. The audio mixer 700 may also send a signal 908 indicating that the signal recorded by a microphone 508 in the user device 710 is to be provided to the user 500.

The user device 710 may also provide a feedback signal 910 to the audio mixer 700. The feedback signal 910 could be used to enable the position of the user 500 to be determined. In some examples the feedback signal 910 could be used to reduce artifacts from appearing as the system 320 switches between different modes of operation.

FIG. 10 schematically illustrates another method according to examples of the disclosure. The example method of FIG. 10 could be implemented using the systems 320 as described above.

At block 1000 the microphone 508 of the user device 710 records the audio scene at the location of the user 500 and provides a coded bitstream of the captured audio scene to the audio mixer 700. In some examples the coded bitstream may comprise a representation of the audio scene. The representation may comprise spectrograms, information indicating the direction of arrival of dominant sound sources in the location of the user 500 and any other suitable information.

In some examples the user device 710 may also provide information relating to user preferences to the audio mixer 700. For example the user of the user device 710 may have selected audio preferences which can then be provided to the audio mixer 700.

At block 1001 the audio mixer 700 selects the content for the output to be provided to the user 500. This selection may comprise selecting which microphone output signals to be removed and reinstated.

At block 1002 the audio mixer 700 identifies the sound objects 12 that are close to the user. The audio mixer 700 may identify the sound objects 12 by comparing the spectral information obtained from the microphone 508 in the user device 710 with the audio data obtained by the plurality of microphones 504. This may enable sound objects 12 that could be recorded by the microphone 508 in the user device 710 to be identified.

Any suitable methods may be used to compare the spectral information obtained from the microphone 508 in the user device 710 with the audio data obtained by the plurality of microphones 504. In some examples the method may comprise matching spectral properties and/or waveform matching for a given set of spatiotemporal coordinates.

At block 1003 the clarity of any identified sound objects 12 is analyzed. This analysis may be used to determine whether or not the microphone 508 in the user device 710 can be used to capture the sound object 12 with sufficient quality.

The analysis of the clarity of the identified sound objects 12 comprises comparing the audio signals from the microphone 508 in the user device 710 with the signals from the plurality of microphones 504. Any suitable methods may be used to compare the signals. In some examples the analysis may combine time-domain and frequency-domain methods. In such examples several separate metrics may be derived from the different captured signals and compared.

At block 1004 the analysis of the sound objects 12 is used to determine whether or not the microphone 508 in the user device 710 can be used to record the sound object 12 and identify which microphone output signals should be included in the output of the audio mixer 700 and which should be replaced with the output of the microphone 508 in the user device 710. This information is provided to the audio mixer 700 to enable the audio mixer 700 to control the mixing of the input channels as required.

Once the audio mixer 700 has received the information indicating the selection of the input channels to be transmitted the audio mixer 700 controls the mixing of the input channels as needed and provides, at block 1005, the modified output to the user device 710.

The methods as described with reference to the Figures may be performed by any suitable apparatus (e.g. apparatus 30), computer program (e.g. computer program 306) or system (e.g. system 320) such as those previously described or similar.

In the foregoing examples, reference has been made to a computer program or computer programs. A computer program, for example either of the computer programs 306 or a combination of the computer programs 306 may be configured to perform the methods.

Also as an example, an apparatus 30 may comprise: at least one processor 302; and at least one memory 304 including computer program code the at least one memory 304 and the computer program code 306 configured to, with the at least one processor 302, cause the apparatus 30 at least to perform: enabling 400 an output of an audio mixer 700 to be rendered for a user 500 where the user 500 is located within a sound space 10, wherein at least one input channel is provided to the audio mixer 700 and the at least one input channel receives a plurality of microphone output signals obtained by a plurality of microphones 504 recording the sound space 10; determining that a microphone 508 associated with the user 500 can be used to record one or more sound objects 12 within the sound space 10; and enabling one or more of the plurality of microphone output signals to be removed from the at least one input channel to the audio mixer 700.

The computer program 306 may arrive at the apparatus 30 via any suitable delivery mechanism. The delivery mechanism may be, for example, a non-transitory computer-readable storage medium, a computer program product, a memory device, a record medium such as a compact disc read-only memory (CD-ROM) or digital versatile disc (DVD), an article of manufacture that tangibly embodies the computer program 306. The delivery mechanism may be a signal configured to reliably transfer the computer program 306. The apparatus 30 may propagate or transmit the computer program 306 as a computer data signal.

It will be appreciated from the foregoing that the various methods described may be performed by an apparatus 30, for example an electronic apparatus 30.

The electronic apparatus 30, may in some examples be a part of an audio output device such as a head-mounted audio output device or a module for such an audio output device. The electronic apparatus 30, may in some examples additionally or alternatively be a part of a head-mounted apparatus comprising the rendering device(s) that renders information to a user visually and/or aurally and/or haptically.

References to "computer-readable storage medium", "computer program product", "tangibly embodied computer program" etc. or a "controller", "computer", "processor" etc. should be understood to encompass not only computers having different architectures such as single /multi-processor architectures and sequential (Von Neumann)/parallel architectures but also specialized circuits such as field-programmable gate arrays (FPGA), application specific circuits (ASIC), signal processing devices and other processing circuitry. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

As used in this application, the term "circuitry" refers to all of the following:

(a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions and (c) to circuits, such as a microprocessor(s) or a portion of a microprocessor(s), that require software or firmware for operation, even if the software or firmware is not physically present.

This definition of "circuitry" applies to all uses of this term in this application, including in any claims. As a further example, as used in this application, the term "circuitry" would also cover an implementation of merely a processor (or multiple processors) or portion of a processor and its (or their) accompanying software and/or firmware. The term "circuitry" would also cover, for example and if applicable to the particular claim element, a baseband integrated circuit or applications processor integrated circuit for a mobile phone or a similar integrated circuit in a server, a cellular network device, or other network device.

The blocks, steps and processes illustrated in the Figures may represent steps in a method and/or sections of code in the computer program. The illustration of a particular order to the blocks does not necessarily imply that there is a required or preferred order for the blocks and the order and arrangement of the block may be varied. Furthermore, it may be possible for some blocks to be omitted.

For instance in some examples the microphone output signals that are removed from the output of the audio mixer 700 are replaced with a signal recorded by the microphone 508 associated with the user 500. In other examples the signal recorded by the microphone 508 associated with the user 500 might not be used and the user could the sound objects 12 directly. This could be useful in implementations where there is very little delay in the outputs provided by the audio mixer 700.

Where a structural feature has been described, it may be replaced by means for performing one or more of the functions of the structural feature whether that function or those functions are explicitly or implicitly described.

As used here "module" refers to a unit or apparatus that excludes certain parts/components that would be added by an end manufacturer or a user. The controller 300 may, for example be a module. The apparatus may be a module. The rendering devices 312 may be a module or separate modules.

The term "comprise" is used in this document with an inclusive not an exclusive meaning. That is any reference to X comprising Y indicates that X may comprise only one Y or may comprise more than one Y. If it is intended to use "comprise" with an exclusive meaning then it will be made clear in the context by referring to "comprising only one" or by using "consisting".

In this brief description, reference has been made to various examples. The description of features or functions in relation to an example indicates that those features or functions are present in that example. The use of the term "example" or "for example" or "may" in the text denotes, whether explicitly stated or not, that such features or functions are present in at least the described example, whether described as an example or not, and that they can be, but are not necessarily, present in some of or all other examples. Thus "example", "for example" or "may" refers to a particular instance in a class of examples. A property of the instance can be a property of only that instance or a property of the class or a property of a sub-class of the class that includes some but not all of the instances in the class. It is therefore implicitly disclosed that a features described with reference to one example but not with reference to another example, can where possible be used in that other example but does not necessarily have to be used in that other example.

Although embodiments of the present invention have been described in the preceding paragraphs with reference to various examples, it should be appreciated that modifications to the examples given can be made without departing from the scope of the invention as claimed.

Features described in the preceding description may be used in combinations other than the combinations explicitly described.

Although functions have been described with reference to certain features, those functions may be performable by other features whether described or not.

Although features have been described with reference to certain embodiments, those features may also be present in other embodiments whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

We claim:

1. A method comprising:

enabling an output of an audio mixer to be rendered for a user where the user is located within a sound space, wherein at least one input channel is provided to the audio mixer and the at least one input channel receives a plurality of microphone output signals obtained with a plurality of microphones recording the sound space;

determining that a first microphone records one or more sound objects within the sound space; and in response to the determining, enabling at least an output of the first microphone to be, at least partially, removed from the output of the audio mixer based on a pre-determined criteria;

wherein the enabling of the output of the audio mixer to be rendered comprises providing the output of the audio mixer for rendering to the user, wherein the output of the first microphone is omitted from the output of the audio mixer based on the pre-determined criteria.

2. The method as claimed in claim 1, comprising replacing at least the, at least partially, removed output of the first microphone in the output provided for rendering to the user with a signal recorded with a different microphone.

3. The method as claimed in claim 1, wherein the first microphone is at least one of:

a microphone associated with the user and is worn by the user; or a microphone located in a headset worn by the user.

4. The method as claimed in claim 1, wherein determining that the first microphone is used to record the one or more sound objects within the sound space comprises at least one of:

determining that a signal captured with the first microphone has at least one parameter within a threshold range;

determining that the user is located within a threshold distance of the one or more sound objects; or identifying one or more microphone output signals that correspond to the one or more sound objects that is recorded with a microphone associated with the user.

5. The method as claimed in claim 1, wherein the plurality of microphones enables the one or more sound objects within the sound space to be isolated.

6. The method as claimed in claim 1, wherein enabling at least the output of the first microphone to be, at least partially, removed from the output of the audio mixer comprises at least one of:

automatically occurring when it is determined that a microphone associated with the user can be used to record the one or more sound objects; or sending a signal to the audio mixer indicating that at least the output of the first microphone can, at least partially, be removed.

7. The method as claimed in claim 6, wherein the signal sent to the audio mixer comprises at least one of:

information that enables a controller to identify at least the output of the first microphone that can be, at least partially, removed; or identification of at least the output of the first microphone that can be, at least partially, removed.

8. The method as claimed in claim 1, wherein a signal recorded with the first microphone is not provided to the audio mixer; and a higher quality output than the output of the first microphone is, at least partially, removed from the output of the audio mixer.

9. The method as claimed in claim 1, wherein at least partially removing at least the output of the first microphone from the output of the audio mixer increases an efficacy of an available bandwidth between the audio mixer and a user device by decreasing an amount of data input to the at least one input channel.

10. The method as claimed in claim 1, wherein at least partially removing at least the output of the first microphone comprises removing at least the output of the first microphone from the at least one input channel to the audio mixer.

11. An apparatus comprising:

processing circuitry; and memory circuitry including computer program code, the memory circuitry and the computer program code configured to, with the processing circuitry, enable the apparatus to:

enable an output of an audio mixer to be rendered for a user where the user is located within a sound space, wherein at least one input channel is provided to the audio mixer and the at least one input channel receives a plurality of microphone output signals obtained with a plurality of microphones recording the sound space;

determine that a first microphone records one or more sound objects within the sound space; and in response to the determining, enable at least an output of the first microphone to be, at least partially, removed from the output of the audio mixer based on a pre-determined criteria;

wherein enabling the output of the audio mixer to be rendered comprises providing the output of the audio mixer for rendering to the user, wherein the output of the first microphone is omitted from the output of the audio mixer based on the pre-determined criteria.

12. The apparatus as claimed in claim 11, wherein the memory circuitry and the computer program code configured to, with the processing circuitry, enable the apparatus to replace at least the, at least partially, removed output of the first microphone in the output provided for rendering to the user with a signal recorded with a different microphone.

13. The apparatus as claimed in claim 11, wherein the first microphone is at least one of:

a microphone associated with the user and is worn by the user; or located in a headset worn by the user.

14. The apparatus as claimed in claim 11, wherein determining that the first microphone is used to record the one or more sound objects within the sound space comprises at least one of:

determining that a signal captured with the first microphone has at least one parameter within a threshold range;

determining that the user is located within a threshold distance of the one or more sound objects; or identifying one or more microphone output signals that correspond to the one or more sound objects that is recorded with a microphone associated with the user.

15. The apparatus as claimed in claim 11, wherein the plurality of microphones enables the one or more sound objects within the sound space to be isolated.

16. The apparatus as claimed in claim 11, wherein enabling at least the output of the first microphone to be, at least partially, removed from the output of the audio mixer comprises:

automatically occurring when it is determined that a microphone associated with the user can be used to record the one or more sound objects; and sending a signal to the audio mixer indicating that at least the output of the first microphone can be, at least partially, removed.

17. The apparatus as claimed in claim 16, wherein the signal sent to the audio mixer comprises at least one of:

information that enables a controller to identify at least the output of the first microphone that can be, at least partially, removed; or identification of at least the output of the first microphone that can be, at least partially, removed.

18. The apparatus as claimed in claim 11, wherein a signal recorded with the first microphone is not provided to the audio mixer;

and a higher quality output than the output of the first microphone is, at least partially, removed from the output of the audio mixer.

19. The apparatus as claimed in claim 11, wherein at least partially removing at least the output of the first microphone from the output of the audio mixer increases an efficacy of an available bandwidth between the audio mixer and a user device.

20. The apparatus as claimed in claim 11, wherein said removed output of the first microphone is no longer provided to the audio mixer.

* * * * *